US005165469A

United States Patent [19]

Smith

[11] Patent Number: 5,165,469

[45] Date of Patent: Nov. 24, 1992

[54] HIGH VISCOUS FLUID HEAT EXCHANGER

[76] Inventor: Douglas W. P. Smith, 3753 Sefton Street, Port Coquitlam, B.C., Canada, V3B 3R6

[21] Appl. No.: 701,920

[22] Filed: May 17, 1991

[51] Int. Cl.[5] ..... F28G 3/10

[52] U.S. Cl. ..... 165/94; 62/354

[58] Field of Search ..... 165/94; 62/354

[56] References Cited

U.S. PATENT DOCUMENTS

| | | | |
|---|---|---|---|
| 2,199,038 | 4/1940 | Brix-Hansen | 62/354 |
| 3,367,126 | 2/1968 | Howell | 62/354 |
| 3,641,783 | 2/1972 | Werner | 165/94 |
| 4,126,177 | 11/1978 | Smith et al. | 165/94 |

FOREIGN PATENT DOCUMENTS

| | | | |
|---|---|---|---|
| 3131770 | 6/1982 | Fed. Rep. of Germany | 165/94 |
| 7809531 | 3/1979 | Netherlands | 165/94 |
| 615347 | 7/1978 | U.S.S.R. | 165/94 |
| 635383 | 11/1978 | U.S.S.R. | 165/94 |

*Primary Examiner*—John Rivell
*Assistant Examiner*—L. R. Leo

[57] ABSTRACT

A heat exchanger for efficient transfer of sensible heat between a highly viscous fluid and a secondary fluid. This exchanger has an annular passage formed between an inner cylinder and outer cylinder. The highly viscous fluid passes through the annular passage while the secondary fluid passes both inside the inner cylinder and outside of the outer cylinder making both cylinders heat transfer surfaces. A scraper mechanism rotates within the annular passage which scrapes both heat transfer surfaces. This scraping action serves to both continually clean the surfaces and to enhance the heat transfer efficiency.

5 Claims, 4 Drawing Sheets

HIGH VISCOUS FLUID HEAT EXCHANGER

FIELD OF INVENTION

This invention relates to a method of efficiently exchanging sensible energy to or from a highly viscous fluid. More specifically the invention relates to a method of enhancing the heat transfer rate and reducing the surface fouling in indirect heat exchange between a highly viscous fluid and a secondary fluid.

DESCRIPTION OF THE PRIOR ART

Highly viscous fluids present a particularly difficult challenge when designing heat transfer equipment. The flow of viscous fluids is laminar and thus the fluid does not mix significantly due to flow action. Heat transfer into a laminar flow is largely dominated by heat conduction through the fluid medium while convection processes are minor. Greater fluid viscosity means a greater relative effect of the conduction process. Since the conduction process is much less efficient for heat transfer than the convection process, indirect heat exchange equipment for high viscous fluids tends to be large and expensive.

A second problem that often occurs with highly viscous fluids is fouling. Many highly viscous fluids have a tendency to adhere to the surfaces they contact, solidify and build up a significant layer of material. This layer of material serves to retard the heat flow and must be taken into account when designing a heat exchanger. This accounting is usually done by designing a larger than normally necessary heat exchanger to include sufficient heat transfer area for the "fouled" condition. Whereas a heat exchanger for a low viscous "dirty" fluid may be a factor of two larger than its "clean" condition would require, a high viscous "dirty" fluid may require an order of magnitude larger heat exchanger. In addition, the tendency to foul surfaces requires that the cross sectional flow area be relatively large to prevent the fouling material from building up to the extent of plugging the equipment. However using a larger cross sectional flow area will reduce the flow velocity and as a result both decrease the heat transfer efficiency and encourage more fouling.

A third problem that sometimes arises relates to the undesirable effects of mixing the highly viscous fluid with the secondary heat transfer fluid. When this is a problem, it is often important to use "thick" welded materials within the heat exchanger to avoid leakage of the secondary heat transfer fluid into the viscous fluid. The common shell-and-tube design using thin walled tubing becomes unacceptable due to the risk of tube failure which would allow direct contact between the fluids.

One solution to the challenge uses a system which includes a shell-and-tube heat exchanger as its primary equipment. The thin walled tubing may dictate limitations on the pressure or temperature of the secondary fluid. To enhance the heat transfer, the fluid velocity is increased by pumping a greater volume through the exchanger. To obtain the temperature rise required the fluid is recirculated through the exchanger. At the outlet end the required amount of high viscous fluid is withdrawn from the recirculating flow and the equivalent amount is input at the inlet end of the exchanger. The recirculation ratio may be 10:1 or greater to obtain the desired results. The disadvantages of such a system includes the thin walled tubing material, the high pumping costs and the large volume of high viscous fluid required in the system at all times. In addition, the control of the system is relatively complex often requiring chemical cleaning sequences at regular intervals.

Another solution to the challenge uses a jacketed tank in which a set of scrapers are installed and driven by an external motor and gear arrangement. The vessel is filled with the high viscous fluid. The scrapers are continuously rotated to scrape the surface to prevent a layer of fouling material from building. The scrapers also tend to act to locally mix the viscous fluid and artificially induce a type of convection heat transfer. The required amount of high viscous fluid is then withdrawn from the vessel and the equivalent amount is input to the vessel. The disadvantages of such a vessel includes the large vessel size, the high costs of operating the motor, the sealing of the scraper drive shaft and the large volume of high viscous fluid required in the system at all times.

SUMMARY OF THE INVENTION

The present invention seeks to improve the methods of transferring heat into or out of a highly viscous fluid. This invention can be applied to fluids of any viscosity, however its relative effectiveness will increase as the fluid viscosity increases. The viscosity at which a fluid may be considered "highly" viscous is the point at which the total heat transfer is dominated by conduction heat transfer processes within the fluid.

The present invention provides an apparatus for mixing the high viscous fluid enhancing the heat transfer, continually scraping the heat transfer surface preventing fouling and using heavy walled materials to ensure ruggedness.

Accordingly, the present invention provides a heat exchanger comprising: an outer enclosure; an inner surface positioned within said outer enclosure to create an annular heat transfer passage between said inner surface and said outer enclosure for receiving a fluid to undergo heat exchange; means for effecting heat exchange with said annular passage; inlet and outlet passages communicating with said annular passage to allow for introduction and removal of said fluid to undergo heat exchange; scraper means rotatably mounted within said annular passage to scrape said annular passage and guide said fluid to undergo heat exchange from said inlet passage to said outlet passage along a predetermined path within said annular passage whereby said fluid undergoes heat exchange during travel through said annular passage.

BRIEF DESCRIPTION OF THE DRAWINGS

Aspects of the invention are illustrated, merely by way of example, in the accompanying drawings in which.

DESCRIPTION OF THE PREFERRED EMBODIMENTS

Figure 1:
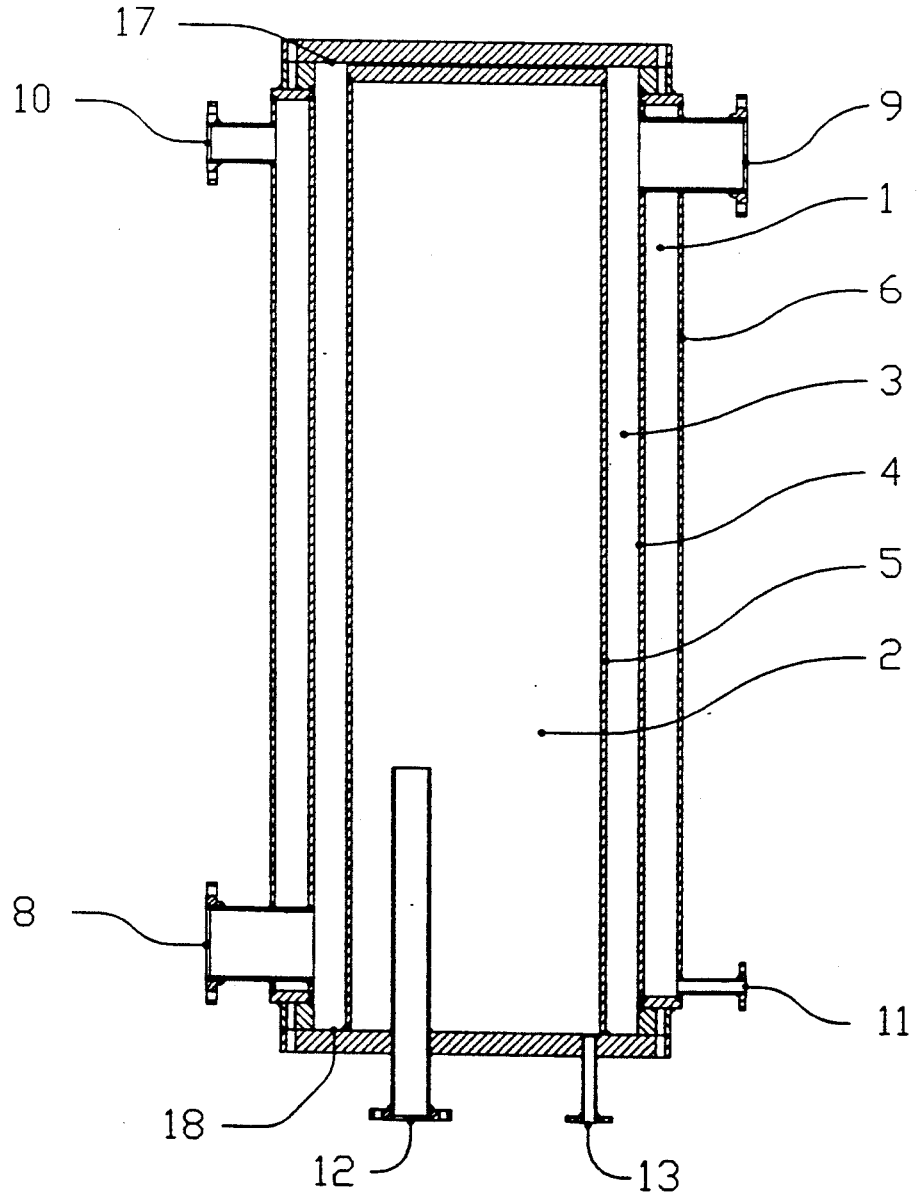
FIG. 1 illustrates one embodiment of the present invention shown, for greater clarity, without the scraper mechanism installed in the annulus.
Figure 2:
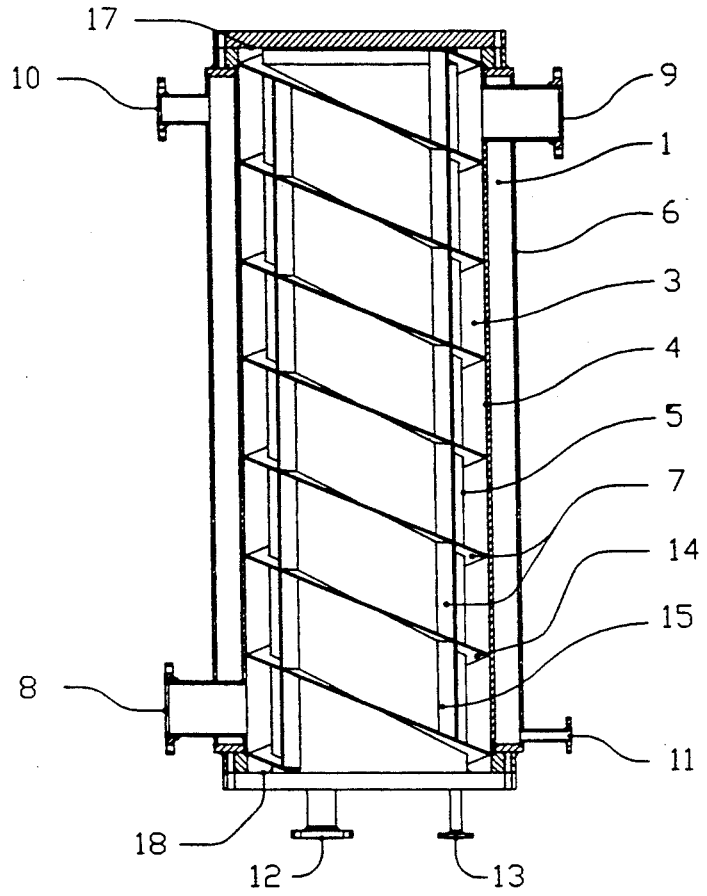
FIG. 2 repeats FIG. 1 with the addition of the scraper mechanism driven by the fluid flow.
Figure 3:
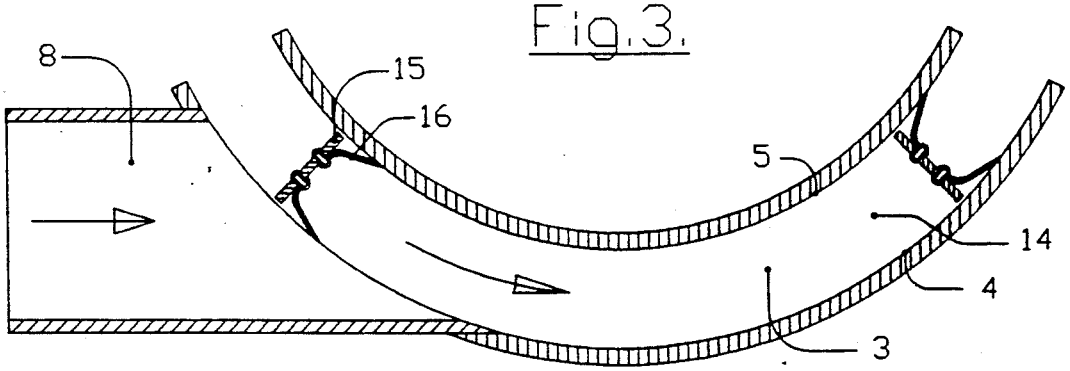
FIG. 3 illustrates detail of the scraper blade shown in FIG. 2.

FIGS. 1, 2 and 3 illustrate a heat exchanger according to a first embodiment of the present invention. There is an outer enclosure 4 that surrounds an inner surface 5 positioned within the outer enclosure to define an annular heat transfer passage 3 therebetween. Passage 3 receives a fluid to undergo heat exchange. The heat exchanger of the present invention is particularly suited for use with fluids that are highly viscous.

There are means for effecting heat exchange with annular passage 3 comprising a sealed jacket 1 formed about the external surface of enclosure 4. Jacket 1 contains a secondary heat transfer medium, for example, water or steam, to supply heat to or receive heat from passage 3. Preferably, outer surface 6 of jacket 1 is insulated to minimize heat exchange with the environment. In addition, inner surface 5 of passage 3 encloses an internal vessel 2 that is also filled with an appropriate secondary heat transfer medium to transfer heat with passage 3. Jacket 1 is provided with an inlet 10 and a lower outlet 11 for movement of the secondary heat transfer medium. Internal vessel 2 is formed with inlet 12 and outlet 13 for the same purpose.

Inlet passage 8 and outlet passage 9 communicate with passage 3 to allow for introduction and removal of a fluid to undergo heat exchange.

Within annular passage 3, scraper means 7 are provided that are rotatably mounted within passage 3 to scrape the walls of the annular passage and guide the fluid to undergo heat exchange from inlet 8 to the outlet 9 along a predetermined path. As best shown in FIGS. 2 and 3, the scraper means includes at least one helical member 14 rotatably mounted within passage 3 and extending over the length of the passage. A plurality of connecting members 15 extend between adjacent coils of helical member 14 at spaced intervals along the length of the helical member. Connecting members 15 and helical member 14 cooperate to define a plurality of discrete unsealed chambers within passage 3. Attached to connecting members 15 are scraper blades 16 that scrape heat transfer surfaces 4 and 5. The scraper means is free floating but confined by ends 17 and 18 of passage 3. Clearances are maintained to minimize fluid passing past helical member 14 or connecting members 15.

Inlet passage 8 is positioned to introduce fluid to undergo heat exchange tangentially into passage 3 thereby imparting a torque loading onto the scraper means. In a similar manner, outlet passage 9 is positioned tangentially to annular passage 3.

In the present embodiment, the rotatable scraper means is driven by the flow of the viscous fluid. In this manner there is no need for an external motor and gear arrangement. This gives the advantage of no rotating seals, simplicity of system design and simplicity of operation. This enhancement works due to the high viscosity of the fluid to undergo heat exchange. When fluid flows with a velocity relative to a surface, the fluid right at the surface is motionless relative to the surface. The velocity of the fluid increases as the distance from the surface increases until the free stream velocity is reached. This region close to the surface where the velocity is reduced is called the boundary layer. When the fluid has a high viscosity, this boundary layer will grow quite large even at relatively high velocities. The scraper mechanism is driven by the flow of the fluid in the free stream region. However the boundary layer region has a reduced velocity and thus the scraper mechanism will "catch up" to the boundary layer fluid and scrape it clear of the surface.

Figure 4:
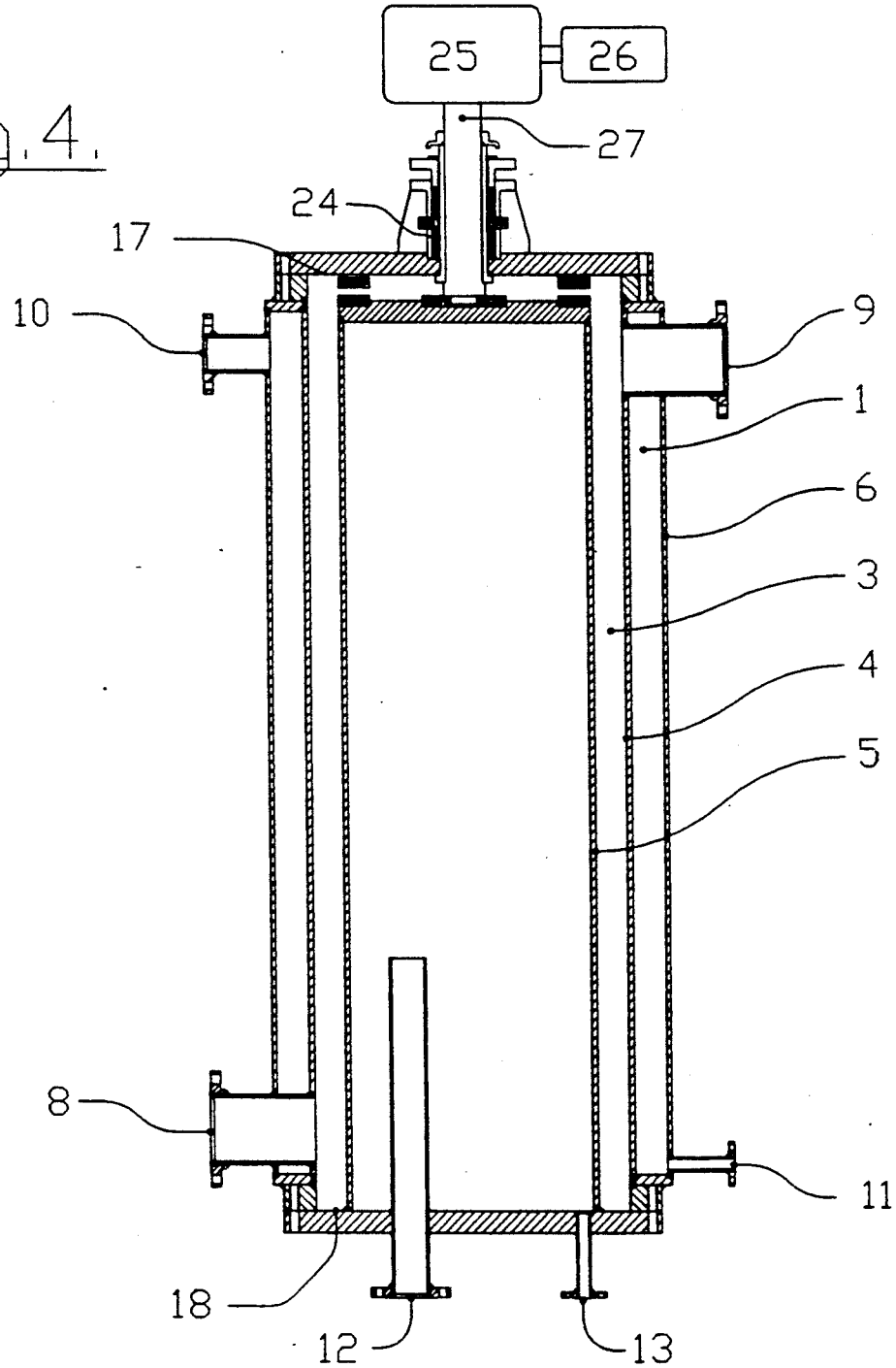
FIG. 4 illustrates an embodiment of the present invention applying an external motor and gear, shown without the scraper mechanism installed in the annulus.
Figure 5:
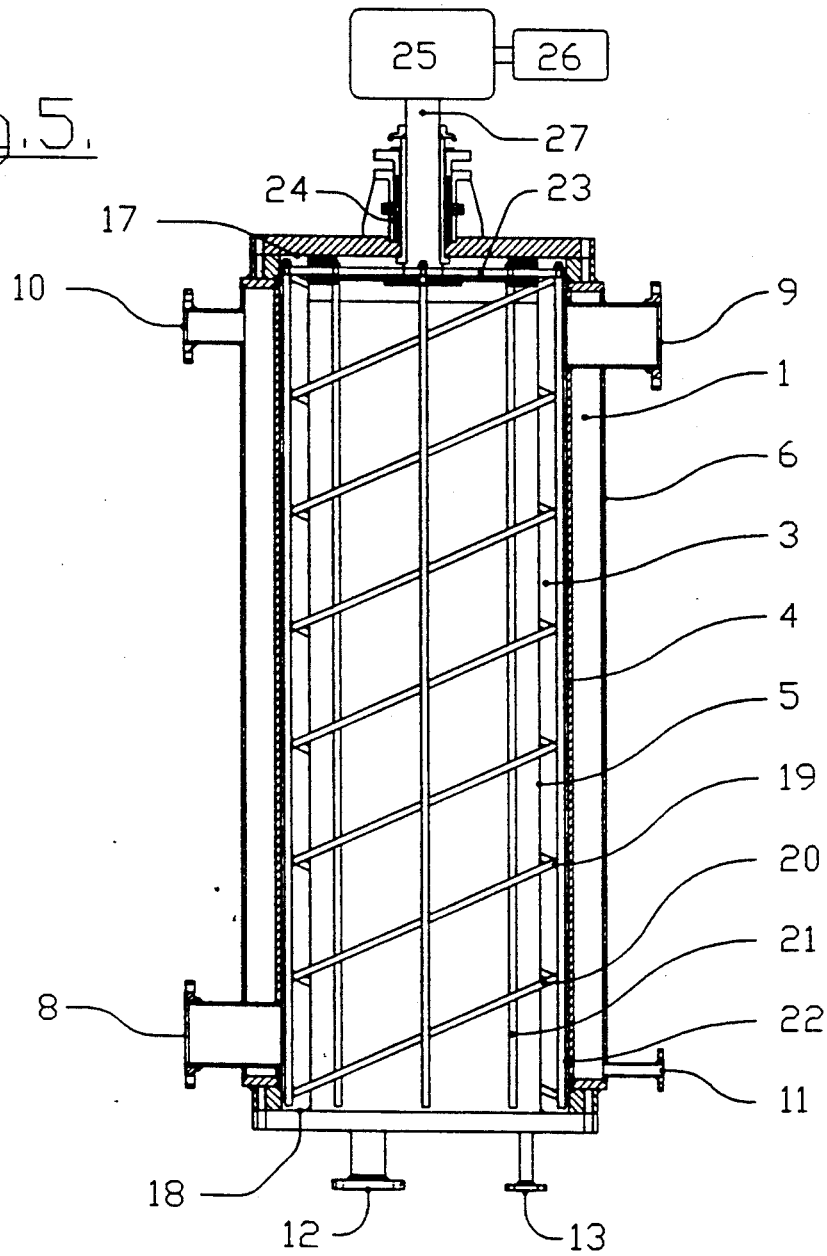
FIG. 5 repeats FIG. 4 with the addition of the scraper mechanism.
Figure 6:
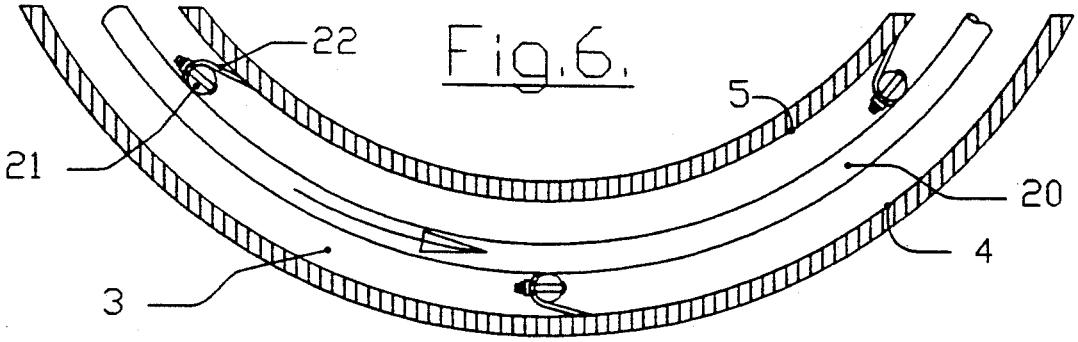
FIG. 6 illustrates a detail of the scraper blade shown in FIG. 5.

FIGS. 4, 5 and 6 illustrate an alternative embodiment of the present invention in which similar parts are identically numbered in accordance with the first embodiment. The embodiment of FIGS. 4, 5 and 6 employs a scraper means 19 that is driven by an external motor and gear 25. The scraper means comprises a spiral member 20 that extends over the length of passage 3. A plurality of essentially vertical scraper support rods 21 are mounted to spiral member 20 and extend axially within passage 3. As best shown in FIG. 6, scraper support rods 21 are mounted in the interior and on the exterior of spiral member 20. Each support rod 21 has an attached scraper blade 22 adapted to engage and scrape the inner or outer wall of annular passage 3. The scraper means 19 is tied together at the top by the drive plate 23. Drive shaft 27 conveys the rotary motion from the motor 26 and gear 25 to the drive plate 23 through the rotary seal 24. Clearances are such that a significant flow of fluid to undergo heat exchange is allowed to pass by the cage rods 20 and support rods 21 allowing the angular velocity of the scraper mechanism 19 to be independent of the flow rate of the fluid to undergo heat exchange. Each one of the scrapers 22 scrape the heat transfer surfaces 4 and 5 completely each revolution.

The apparatus of the present invention finds particular application in the treatment of a high solids content black liquor to be heated prior to being fired in a recovery boiler in a pulp mill. In such an application, steam is used as the secondary heat transfer medium and is condensed to impart heat to the black liquor. The black liquor may contain more than 70% solids and have a viscosity of about 700 centipoise at 250° F.

In use, the heat exchanger of the present invention firstly directs the fluid to undergo heat transfer through an annular heat transfer passage formed by both an inner and outer heat transfer surface. The inner surface of the annular passage is formed by a cylinder which contains the steam supplying the heat. The outer enclosure of the annular passage is formed by another cylinder which has an integral jacket and also passes the steam supplying the heat. The annular passage encloses a rotating scraper mechanism which both scrapes the heat transfer surface and constantly removes and replaces the boundary layer of black liquor.

The dominant heat transfer mechanism is conduction of heat from the heat transfer surface into the viscous fluid. This is a time dependant mechanism in that as the heat conducts into the fluid the rate of heat transfer decreases. Since the initial heat transfer rate is the greatest, it is advantageous to maintain conditions which simulate the initial conduction heat transfer conditions. The rotating scraper mechanism does this by "scraping off" the heated boundary layer at regular short time intervals and allowing it to be replaced by fluid from outside the boundary layer. The design of the scraper mechanism and its angular velocity determine the time interval of the scraping action. The advantages of the present invention include a large heat transfer surface within a small heat exchanger, efficient heat transfer due to self cleaning and artificial fluid mixing, low pressure drop of once-through flow and a small volume of fluid within the system at any given time.

The present invention provides a simple yet efficient heat exchanger for use with highly viscous fluids. This invention is of wider application than that of heating black liquor. It is useful whenever a high viscous fluid is involved and in addition, but not limited to, when the fluid is also "dirty" and will foul heat transfer surfaces. Such applications may include viscous pure fluids, polymers or fluids with suspended solids. In each application the size of the unit must be designed specifically to meet the particular heat transfer criteria and fluid properties.

Although the present invention has been described in some detail by way of example for purposes of clarity and understanding, it will be apparent that certain changes and modifications may be practised within the scope of the appended claims.

I claim:

1. A heat exchanger comprising:

an outer enclosure;

an inner surface positioned within said outer enclosure to create an annular heat transfer passage between said inner surface and said outer enclosure for receiving a fluid to undergo heat exchange;

means for effecting heat exchange with said annular passage;

inlet and outlet passages communicating with said annular passage to allow for introduction and removal of said fluid to undergo heat exchange;

scraper means comprising a spiral member positioned for rotatable movement with said annular passage, a plurality of scraper support members extending axially within said annular passage and mounted in the interior and on the exterior of said spiral member and scraper blades attached to said scraper support members that engage the inner and outer walls of said annular passage to scrape said annular passage walls and guide said fluid to undergo heat exchange from said inlet passage to said outlet passage along a predetermined path within said annular passage whereby said fluid undergoes heat exchange during travel through said annular passage; and drive means to rotatable drive said scraper means.

2. A heat exchanger as claimed in claim 1 in which said inlet passage is positioned to introduce fluid to undergo heat exchange tangentially into said annular passage.

3. A heat exchanger as claimed in claim 1 in which said outlet passage is positioned to remove fluid to undergo heat exchange tangentially form said annular passage.

4. A heat exchanger as claimed in claim 1 in which said means for effecting heat exchange with said annular passage comprises a sealed jacket formed about said outer enclosure adapted to contain a heat transfer medium.

5. A heat exchanger as claimed in claim 1 in which said means for effecting heat exchange with said annular passage comprises an internal vessel enclosed by said inner surface, said internal vessel being adapted to contain a heat transfer medium.

* * * * *